US006430862B1

(12) United States Patent
Berlin

(10) Patent No.: US 6,430,862 B1
(45) Date of Patent: Aug. 13, 2002

(54) PLUG INSERTION AND REMOVAL TOOL FOR A HANDGUN

(76) Inventor: David H. Berlin, 3215 Shadydale La., West Bloomfield, MI (US) 48323

( * ) Notice: Subject to any disclaimer, the term of this patent is extended or adjusted under 35 U.S.C. 154(b) by 7 days.

(21) Appl. No.: 09/815,716

(22) Filed: Mar. 23, 2001

(51) Int. Cl.[7] ..... F41C 27/00
(52) U.S. Cl. ..... 42/90; 29/270; 29/278
(58) Field of Search ..... 42/90, 106; 254/10.5; 29/270, 278, 280

(56) References Cited

U.S. PATENT DOCUMENTS

| | | | | |
|---|---|---|---|---|
| 2,669,772 A | * | 2/1954 | Hamler | 29/229 |
| 3,153,296 A | * | 10/1964 | Hofstetter | 42/87 |
| D264,169 S | | 5/1982 | Guttman | |
| 4,442,619 A | | 4/1984 | McCarley | |
| 4,483,060 A | | 11/1984 | Farrar et al. | |
| 4,878,306 A | | 11/1989 | Dyer | |
| 4,901,411 A | | 2/1990 | Chestnut et al. | |
| 5,419,070 A | | 5/1995 | Rinehart | |

* cited by examiner

*Primary Examiner*—Charles T. Jordan
*Assistant Examiner*—John W. Zerr

(57) ABSTRACT

A plug insertion and removal tool for a handgun for effectively and easily taking apart and putting together a handgun. The plug insertion and removal tool for a handgun includes a tool member including a handle member having a front end, a scoop member being securely attached to the front end of the handle member and extending forwardly therefrom and having a laterally curved wall, and a plug depressing member securely attached to the front end of the handle member and being disposed in the scoop member.

9 Claims, 2 Drawing Sheets

PLUG INSERTION AND REMOVAL TOOL FOR A HANDGUN

BACKGROUND OF THE INVENTION

1. Field of the Invention

The present invention relates to a plug plunger and more particularly pertains to a new plug insertion and removal tool for a handgun for effectively and easily taking apart and putting together a handgun.

2. Description of the Prior Art

The use of a plug plunger is known in the prior art. More specifically, a plug plunger heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,483,060; U.S. Pat. No. 4,901,411; U.S. Pat. No. 4,878,306; U.S. Pat. No. 4,442,619; U.S. Pat. No. 5,419,070; and U.S. Pat. No. Des. 264,169.

While these devices fulfill their respective, particular objectives and requirements, the aforementioned patents do not disclose a new plug insertion and removal tool for a handgun. The inventive device includes a tool member including a handle member having a front end, a scoop member being securely attached to the front end of the handle member and extending forwardly therefrom and having a laterally curved wall, and a plug depressing member securely attached to the front end of the handle member and being disposed in the scoop member.

In these respects, the plug insertion and removal tool for a handgun according to the present invention substantially departs from the conventional concepts and designs of the prior art, and in so doing provides an apparatus primarily developed for the purpose of effectively and easily taking apart and putting together a handgun.

SUMMARY OF THE INVENTION

In view of the foregoing disadvantages inherent in the known types of plug plunger now present in the prior art, the present invention provides a new plug insertion and removal tool for a handgun construction wherein the same can be utilized for effectively and easily taking apart and putting together a handgun.

The general purpose of the present invention, which will be described subsequently in greater detail, is to provide a new plug insertion and removal tool for a handgun which has many of the advantages of the plug plunger mentioned heretofore and many novel features that result in a new plug insertion and removal tool for a handgun which is not anticipated, rendered obvious, suggested, or even implied by any of the prior art plug plunger, either alone or in any combination thereof.

To attain this, the present invention generally comprises a tool member including a handle member having a front end, a scoop member being securely attached to the front end of the handle member and extending forwardly therefrom and having a laterally curved wall, and a plug depressing member securely attached to the front end of the handle member and being disposed in the scoop member.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new plug insertion and removal tool for a handgun which has many of the advantages of the plug plunger mentioned heretofore and many novel features that result in a new plug insertion and removal tool for a handgun which is not anticipated, rendered obvious, suggested, or even implied by any of the prior art plug plunger, either alone or in any combination thereof.

It is another object of the present invention to provide a new plug insertion and removal tool for a handgun which may be easily and efficiently manufactured and marketed.

It is a further object of the present invention to provide a new plug insertion and removal tool for a handgun which is of a durable and reliable construction.

An even further object of the present invention is to provide a new plug insertion and removal tool for a handgun which is susceptible of a low cost of manufacture with regard to both materials and labor, and which accordingly is then susceptible of low prices of sale to the consuming public, thereby making such plug insertion and removal tool for a handgun economically available to the buying public.

Still yet another object of the present invention is to provide a new plug insertion and removal tool for a handgun which provides in the apparatuses and methods of the prior art some of the advantages thereof, while simultaneously overcoming some of the disadvantages normally associated therewith.

Still another object of the present invention is to provide a new plug insertion and removal tool for a handgun for effectively and easily taking apart and putting together a handgun.

Yet another object of the present invention is to provide a new plug insertion and removal tool for a handgun which includes a tool member including a handle member having a front end, a scoop member being securely attached to the front end of the handle member and extending forwardly therefrom and having a laterally curved wall, and a plug depressing member securely attached to the front end of the handle member and being disposed in the scoop member.

Still yet another object of the present invention is to provide a new plug insertion and removal tool for a handgun that prevents the handgun from being scratched during the taking apart and putting back together of the handgun.

Even still another object of the present invention is to provide a new plug insertion and removal tool for a handgun that prevents the parts including the spring and plug from flying apart during the removal thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
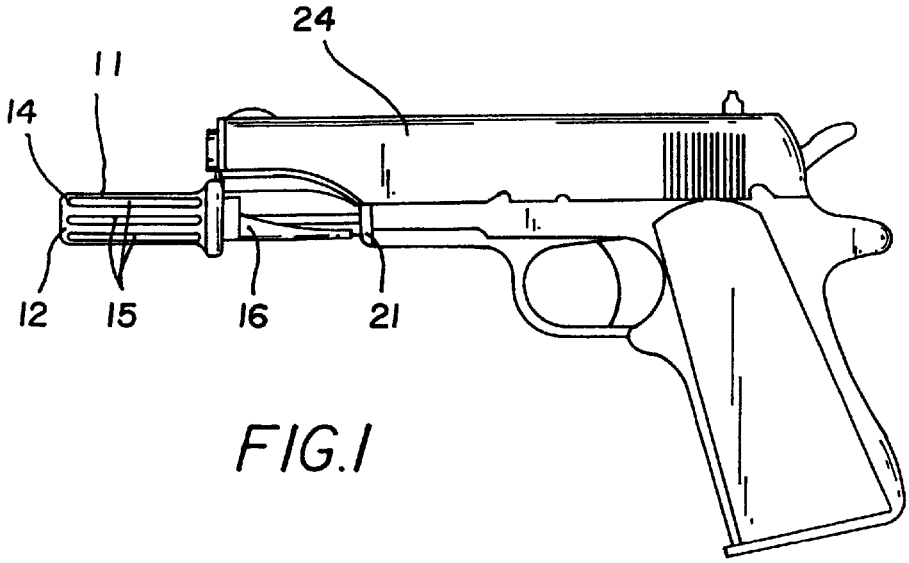
FIG. 1 is a side elevational view of a new plug insertion and removal tool for a handgun according to the present invention and shown in use.
Figure 2:
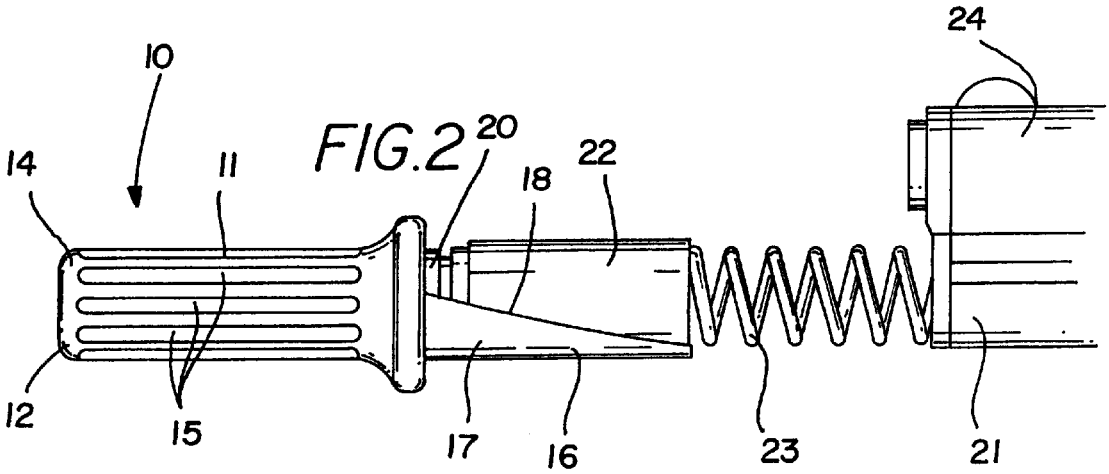
FIG. 2 is a detailed side elevational view of the present invention shown in use.
Figure 3:
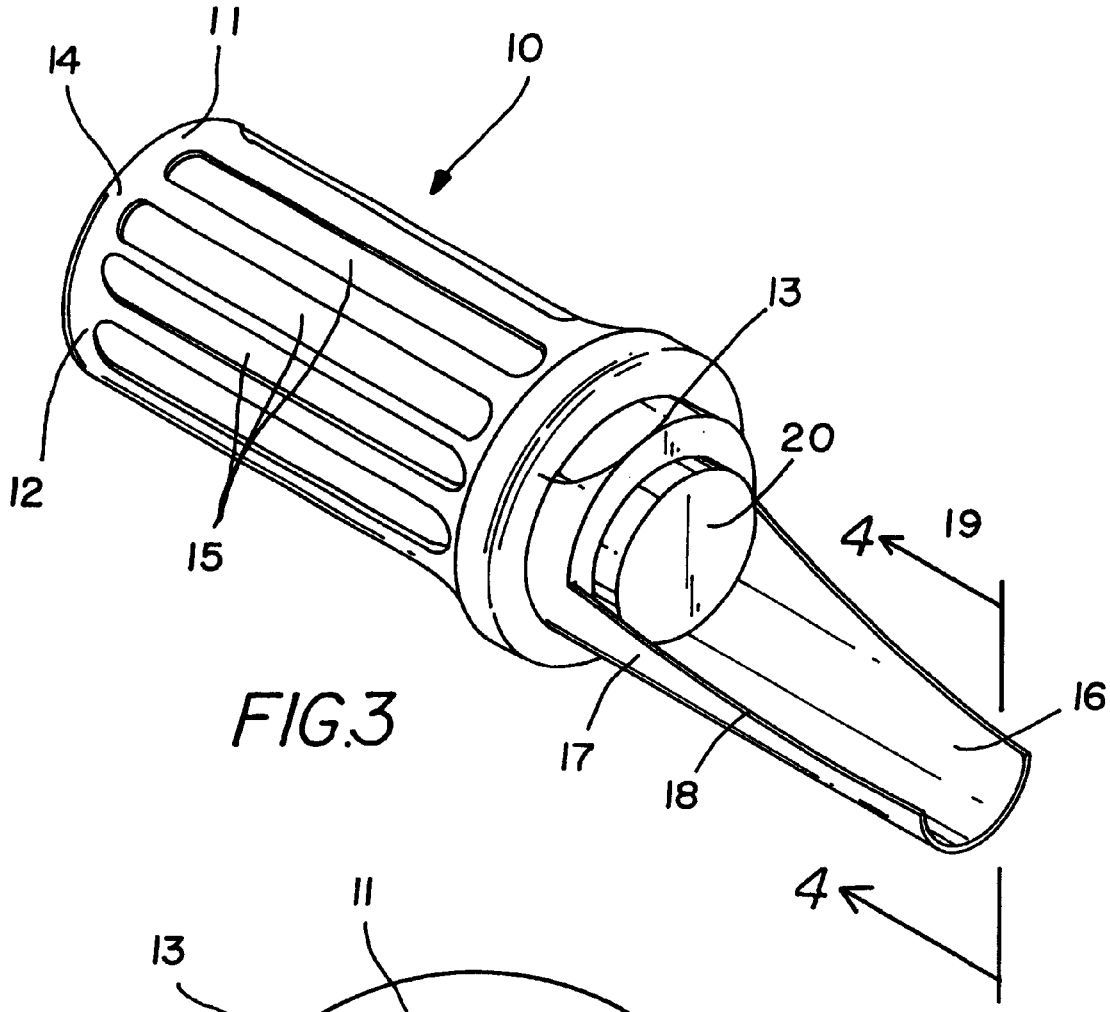
FIG. 3 is a perspective view of the present invention.
Figure 4:
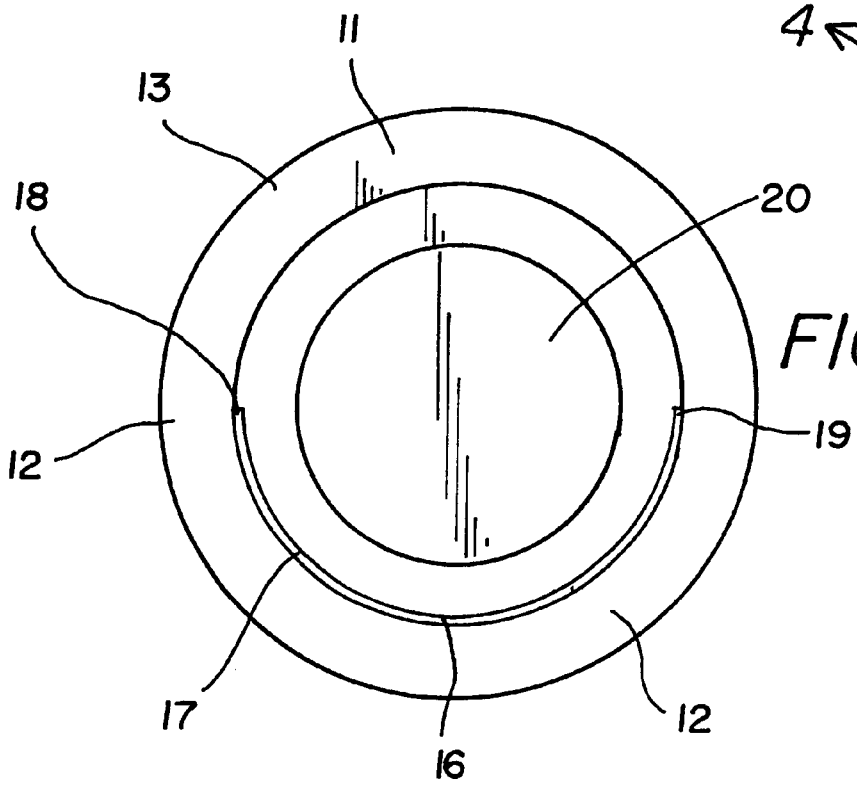
FIG. 4 is a front end view of the present invention.

With reference now to the drawings, and in particular to FIGS. 1 through 4 thereof, a new plug insertion and removal tool for a handgun embodying the principles and concepts of the present invention and generally designated by the reference numeral 10 will be described.

As best illustrated in FIGS. 1 through 4, the plug insertion and removal tool for a handgun 10 generally comprises a tool member 11 including a handle member 12 having a front end, 13, a scoop member 16 securely and conventionally attached to the front end 13 of the handle member 12 and extending forwardly therefrom, and a plug depressing member 20 securely and conventionally attached to the front end 13 of the handle member 12 and disposed in the scoop member 16 at a back end thereof. The scoop member 16 is adapted to fit about a bottom of a barrel shroud 21 where a plug 22 in located in the handgun 24. The handle member 12 is essentially cylindically-shaped and has a side wall 14 with a plurality of longitudinal grooves 15 spaced apart and disposed in the side wall 14 for providing a gripping surface for a user. The scoop member 16 has a laterally curved wall 17 extending outwardly from a bottom of the front end 13 of the handle member 12. The wall 17 of the scoop member 16 has a pair of opposed longitudinal edges 18,19 which extend from the back end to a front end of the scoop member 16. Each of the longitudinal edges 18,19 is curved downwardly from the back end to the front end of the scoop member 16. The plug depressing member 20 is essentially a boss member extending forwardly of the handle member 12 and being disposed in the scoop member 16 for depressing a spring 23 disposed in the barrel shroud 21 of a handgun 24 to effectively release the plug 22. The boss member 20 is generally disc-shaped and is adapted to engage the plug 22 in the barrel shroud 21. The tool member 11 has a length of approximately 3 inches and a diameter of approximately 1 inch.

In use, the user places the scoop member 16 about the bottom of the barrel shroud 21 and depresses the plug 22 by moving the handle member 12 toward. the barrel shroud 21 with the plug depressing member 20 depressing the spring 23 retaining the plug 22 in the barrel shroud 21 to release the plug 22 which rests upon the scoop member 16 as the user removes the tool member 11 from about the barrel shroud 21. To place the plug 22 back into the barrel shroud 21, the user reverses the steps for removing the plug 22.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A plug insertion and removal tool for a handgun comprising:

a tool member including a handle member having a front end, a scoop member securely attached to said front end of said handle member and extending forwardly therefrom, and a plug depressing member securely attached to said front end of said handle member and disposed in said scoop member at a back end thereof, said scoop member being adapted to fit about a bottom of a barrel shroud where a plug is located.

2. A plug insertion and removal tool for a handgun as described in claim 1, wherein said handle member is essentially cylindically-shaped and has a side wall with a plurality of longitudinal grooves spaced apart and disposed in said side wall for providing a gripping surface for a user.

3. A plug insertion and removal tool for a handgun as described in claim 2, wherein said scoop. member has a laterally curved wall extending outwardly from a bottom of said front end of said handle member.

4. A plug insertion and removal tool for a handgun as described in claim 3, wherein said wall of said scoop member has a pair of opposed longitudinal edges which extend from said back end to a front end of said scoop member.

5. A plug insertion and removal tool for a handgun as described in claim 4, wherein each of said longitudinal edges are curved downwardly from said back end to said front end of said scoop member.

6. A plug insertion and removal tool for a handgun as described in claim 5, wherein said plug depressing member is essentially a boss member extending forwardly of said handle member and being disposed in said scoop member for depressing a spring disposed in the barrel shroud of a handgun to effectively release the plug.

7. A plug insertion and removal tool for a handgun as described in claim 6, wherein said boss member is generally disc-shaped and is adapted to engage the plug in the barrel shroud.

8. A plug insertion and removal tool for a handgun as described in claim 7, wherein said tool member has a length of approximately 3 inches and a diameter of approximately 1 inch.

9. A plug insertion and removal tool for a handgun comprising:

a tool member including a handle member having a front end, a scoop member securely attached to said front end of said handle member and extending forwardly therefrom, and a plug depressing member securely attached to said front end of said handle member and disposed in said scoop member at a back end thereof, said scoop member being adapted to fit about a bottom of a barrel shroud where a plug is located, said handle member being essentially cylindically-shaped and having a side wall with a plurality of longitudinal grooves spaced apart and disposed in said side wall for providing a gripping surface for a user, said scoop member having a laterally curved wall extending outwardly from a bottom of said front end of said handle member, said wall of said scoop member having a pair of opposed longitudinal edges which extend from said back end to a front end of said scoop member, each of said longitudinal edges being curved downwardly from said back end to said front end of said scoop member, said plug depressing member being essentially a boss member extending forwardly of said handle member and being disposed in said scoop member for depressing a spring disposed in the barrel shroud of a handgun to effectively release the plug, said boss member being generally disc-shaped and is adapted to engage the plug in the barrel shroud, said tool member having a length of approximately 3 inches and a diameter of approximately 1 inch.

* * * * *